US010446292B2

(12) United States Patent
Ning et al.

(10) Patent No.: US 10,446,292 B2
(45) Date of Patent: Oct. 15, 2019

(54) COMPOSITE CABLE

(71) Applicant: HEYI INTELLIGENT TECHNOLOGY (SHENZHEN) CO., LTD., Beijing (CN)

(72) Inventors: Chao Ning, Beijing (CN); Qian Cao, Beijing (CN); Wenhua Su, Beijing (CN); Jian Yao, Beijing (CN); Baiyu Pan, Beijing (CN); Ji Wang, Beijing (CN)

(73) Assignee: Heyi Intelligent Technology (Shenzhen) Co., Ltd, Beijing (CN)

( * ) Notice: Subject to any disclaimer, the term of this patent is extended or adjusted under 35 U.S.C. 154(b) by 0 days.

(21) Appl. No.: 15/752,712

(22) PCT Filed: Sep. 12, 2016

(86) PCT No.: PCT/CN2016/098665
§ 371 (c)(1),
(2) Date: Feb. 14, 2018

(87) PCT Pub. No.: WO2017/152610
PCT Pub. Date: Sep. 14, 2017

(65) Prior Publication Data

US 2018/0240571 A1 Aug. 23, 2018

(30) Foreign Application Priority Data

Mar. 7, 2016 (CN) ..... 2016 1 0127713

(51) Int. Cl.
*H01B 11/04* (2006.01)
*H01B 11/06* (2006.01)
(Continued)

(52) U.S. Cl.
CPC ..... *H01B 11/1033* (2013.01); *H01B 7/0045* (2013.01); *H01B 7/17* (2013.01); *H01B 11/06* (2013.01); *H01B 13/2606* (2013.01)

(58) Field of Classification Search
CPC ..... H01B 11/04; H01B 11/06
(Continued)

(56) References Cited

U.S. PATENT DOCUMENTS 3,215,768 A * 11/1965 Murphy ..... H01B 9/024 156/54
3,594,491 A 7/1971 Zeidlhack et al.
(Continued)

FOREIGN PATENT DOCUMENTS

CN 200983281 11/2007
CN 201489867 5/2010
(Continued)

*Primary Examiner* — Chau N Nguyen
(74) *Attorney, Agent, or Firm* — Occhiuti & Rohlicek LLP

(57) ABSTRACT

The present disclosure relates to a composite cable, which comprises a first wire assembly and a second wire assembly, and each wire of the second wire assembly is surrounded by an insulating layer. The composite cable further comprises: a sheath made of insulating material and configured to enclose the first wire assembly and the second wire assembly; and a shield comprising different kinds of metal wires and configured to surround the first wire assembly, wherein the first wire assembly is capable of transmitting signals, and the second wire assembly is capable of transmitting power supply. The composite cable according to the present disclosure is excellent in shielding performance for different requirements.

11 Claims, 7 Drawing Sheets

(51) Int. Cl.

| | |
|---|---|
| ***H01B 11/10*** | (2006.01) |
| ***H01B 13/26*** | (2006.01) |
| ***H01B 7/00*** | (2006.01) |
| ***H01B 7/17*** | (2006.01) |

(58) Field of Classification Search
USPC ..... 174/36, 113 R
See application file for complete search history.

(56) References Cited

U.S. PATENT DOCUMENTS

| | | | | |
|---|---|---|---|---|
| 4,641,110 | A | 2/1987 | Smith | |
| 5,956,445 | A * | 9/1999 | Deitz, Sr. | G02B 6/441 174/24 |
| 8,076,580 | B2 * | 12/2011 | Kolasa | H01B 11/00 174/105 R |
| 9,508,467 | B2 * | 11/2016 | Pon | H01B 9/003 |
| 2003/0121694 | A1 * | 7/2003 | Grogl | H01B 3/441 174/113 R |
| 2003/0132022 | A1 | 7/2003 | Williams et al. | |
| 2014/0238722 | A1 | 8/2014 | Hayashishita et al. | |
| 2015/0083482 | A1 | 3/2015 | Eshima et al. | |

FOREIGN PATENT DOCUMENTS

| | | |
|---|---|---|
| CN | 102097161 | 6/2011 |
| CN | 202189598 | 4/2012 |
| CN | 102097161 | 1/2013 |
| CN | 202771817 | 3/2013 |
| CN | 204010758 | 12/2014 |
| CN | 104392796 | 3/2015 |
| CN | 105788710 | 7/2016 |
| GB | 502122 | 3/1939 |
| JP | 06-60730 | * 3/1994 |
| JP | 2002-216550 | 8/2002 |
| JP | 2006-331758 | * 12/2006 |
| JP | 5019730 | 3/2007 |
| JP | 3195066 | 12/2014 |

* cited by examiner

COMPOSITE CABLE

CROSS-REFERENCE TO RELATED APPLICATION

This application is the national stage, under 35 USC 371 of PCT application PCT/CN2016/098665, filed on Sep. 12, 2016, and claims priority to CN Patent Application No. 201610127713.3, filed on Mar. 7, 2016, the entire contents of which are incorporated herein by reference.

TECHNICAL FIELD

The present disclosure relates to a transmission cable, and in particular, to a composite cable.

BACKGROUND

As the data communication as well as the information technology grows at a high speed, there is an increasingly high demand for the performance of a transmission cable. At present, there exists a composite cable where a signal line and a power line are integrated with each other. For such a composite cable, an effective shield must be provided between power supply transmitted by the power line and signals transmitted by the signal line, interference signals from the outside must be shielded off while signals are being transmitted through the line, and signals transmitted through the line must not interfere with the external environment. In order to meet the above requirements, for some cables, the cable has its core surrounded by a layer of metal net for shield. However, the metal has different shielding capabilities for various physical fields such as an electric field and a magnetic field, so it is difficult for a metal net to meet requirements for shielding different physical fields.

SUMMARY

To address the above problem, the present disclosure provides a composite cable that makes use of properties of different kinds of metals and performs excellently when there are different shielding requirements.

According to one aspect of the present disclosure, there is provided a composite cable, comprising a first wire assembly and a second wire assembly, each wire in the second wire assembly being surrounded by an insulating layer, the composite cable further comprising: a sheath made of insulating material and configured to enclose the first wire assembly and the second wire assembly; and a shield comprising different kinds of metal wires and configured to surround the first wire assembly, wherein the first wire assembly is capable of transmitting signals, and the second wire assembly is capable of transmitting power supply.

In an embodiment of the one aspect, the shield is formed with a netlike structure which is woven from a wire harness formed by the different kinds of metal wires.

In an embodiment of the one aspect, the different kinds of metal wires comprise an electric-shielding metal wire and a magnetic-shielding metal wire.

In an embodiment of the one aspect, the electric-shielding metal wire comprises a copper wire.

In an embodiment of the one aspect, the magnetic-shielding metal wire comprises an iron wire.

In an embodiment of the one aspect, the first wire assembly comprises one or more first wire sub-assemblies, the second wire assembly comprises at least two wires, and the first wire sub-assemblies and the wires in the second wire assembly are arranged to sufficiently fill a space inside the sheath.

In an embodiment of the one aspect, a wire harness formed by the first wire sub-assemblies and the wires in the second wire assembly, has a cross section whose outline is a polygon symmetric with respect to a diameter of the composite cable.

In an embodiment of the one aspect, a wire harness formed by the first wire sub-assemblies and the wires in the second wire assembly, has a cross section whose outline is circular-like.

In an embodiment of the one aspect, each of the first wire sub-assemblies is surrounded by a shield comprising different kinds of metal wires.

In an embodiment of the one aspect, the first wire assembly comprises one or more of a high definition multimedia interface (HDMI) wire, a user-defined signal line, a control line, a data line, a DC power supply line and a ground wire.

Some embodiments may have one or more of the following advantages.

The composite cable according to the present disclosure is excellent in shielding performance when there are different shielding requirements.

Additional features and aspects of the present disclosure will become apparent from the following description of exemplary embodiments with reference to the attached drawings.

BRIEF DESCRIPTION OF THE DRAWINGS

The drawings, which are incorporated in and constitute part of the specification, together with the description, illustrate exemplary examples, features and aspects of the present disclosure and serve to explain the principles of the present disclosure.

DETAILED DESCRIPTION

Figure 1:
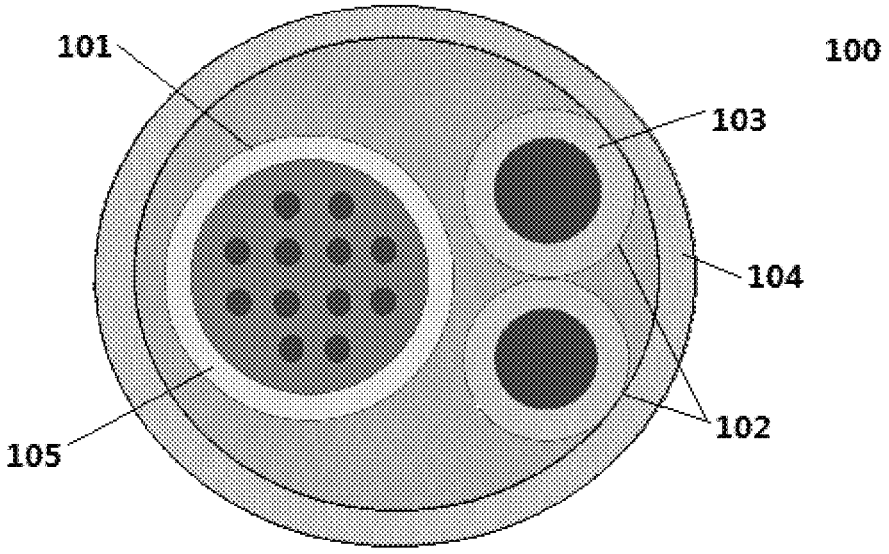
FIG. 1 is a schematic structural diagram showing a composite cable according to an embodiment of the present disclosure.

Various exemplary embodiments, features and aspects of the present disclosure will be described in detail with reference to the drawings. The same reference numerals in the drawings represent parts having the same or similar functions. Although various aspects of the embodiments are shown in the drawings, it is unnecessary to proportionally draw the drawings unless otherwise specified.

Herein the term "exemplary" means "used as an instance or example, or explanatory". An "exemplary" embodiment given here is not necessarily construed as being superior to or better than other embodiments.

Numerous details are given in the following examples for the purpose of better explaining the present disclosure. It should be understood by a person skilled in the art that the present disclosure can still be realized even without some of those details. In some of the examples, methods, means, units and circuits that are well known to a person skilled in the art are not described in detail so that the principle of the present disclosure become apparent.

Embodiment 1

FIG. 1 is a schematic structural diagram showing a composite cable 100 according to an embodiment of the present disclosure. As shown in FIG. 1, the composite cable 100 primarily comprises: a first wire assembly 101; a second wire assembly 102, wherein each wire of the second wire assembly 102 is surrounded by an insulating layer 103; a sheath 104 that encloses the first wire assembly 101 and the second wire assembly 102, and is made of insulating material; and a shield 105 that contains different kinds of metal wires and surrounds the first wire assembly 101. Wherein the first wire assembly 101 is capable of transmitting signals, and the second wire assembly 102 is capable of transmitting power supply.

The composite cable according to this embodiment uses a shield containing different kinds of metal wires to surround the first wire assembly 101 that servers to transmit a signal, so as to form a shield for the first wire assembly 101. Since different kinds of metals have different shielding capabilities for different physical fields, the shield, which comprises different kinds of metal wires, is capable of providing an effective shield regardless of different physical fields, and thus provides excellent shielding performance for different anti-interference requirements.

As an example of the first wire assembly 101, it may include a plurality of wires for transmitting signals, such as an HDMI wire, a user-defined signal line, a control line and a data line, etc. In addition, the first wire assembly 101 may further include a DC power supply line for transmitting DC power and a ground wire. The interior of the shield 105 may be filled with insulating material to isolate wires of the first wire assembly 101 from each other.

As an example of the second wire assembly, it may comprise a wire used to transmit power supply, such as a fire wire and a zero line that are used to transmit AC power of 220V.

Figure 2:
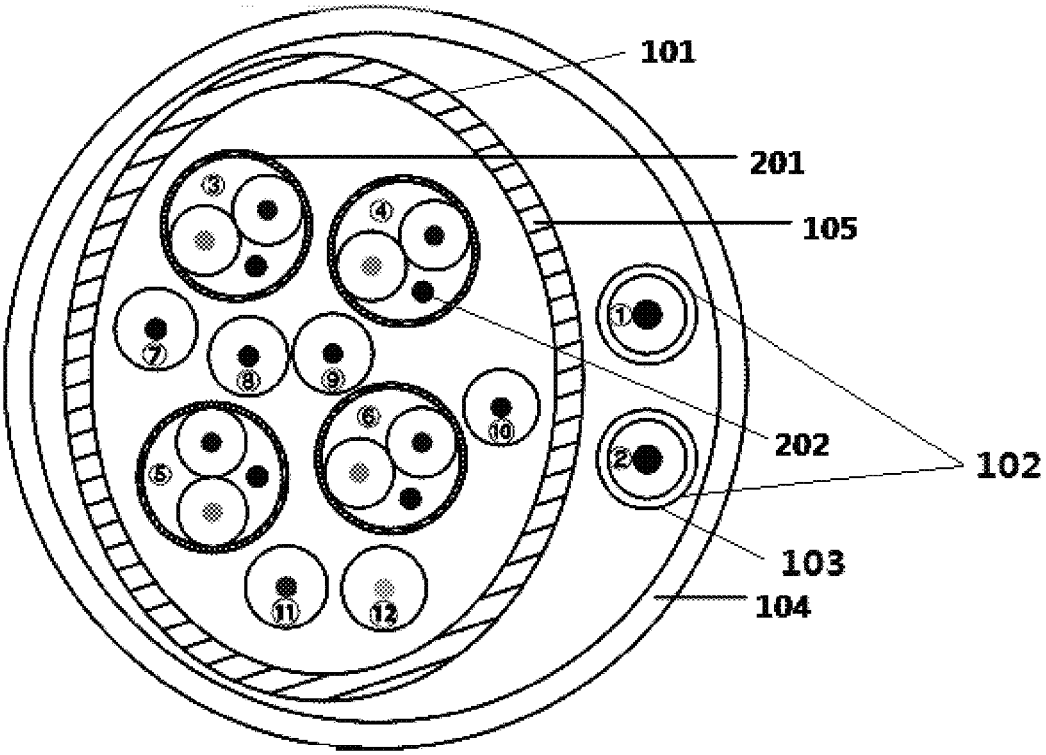
FIG. 2 is a schematic structural diagram showing an example of a composite cable according to an embodiment of the present disclosure.

FIG. 2 is a schematic structural diagram showing an example of a composite cable according to an embodiment of the present disclosure. As shown in FIG. 2, the second wire assembly 102 includes wire(s) 1 and wire(s) 2, which are a fire wire and a zero line, respectively. The fire wire and zero line are both surrounded by an insulating layer 103. The insulating layer may be made of insulating material such as polyvinyl chloride (PVC) and may have one or more layers, such as two layers. The first wire assembly 101 may include a plurality of wires, such as 10 wires (numbered with "3" to "12"), or may include any other number of wires as needed.

In the example shown in FIG. 2, the plurality of wires may include wire(s) 3, wire(s) 4, wire(s) 5 and wire(s) 6 whose cores may be made of, for instance, pure copper, and the wire(s) 3, wire(s) 4, wire(s) 5 and wire(s) 6 may be surrounded, respectively, by a metal material layer for shield, such as an aluminum foil 201. The aluminum foil 201 may be connected to the cores 202 of the wires 3-6 for grounding. The aluminum foil 201 may be replaced with the above shield that contains different kinds of metal wires. In this example, the cores of the wires 3, 4, 5 and 6 may be, for instance, a positive signal line and a negative signal line respectively used to transmit a differential signal, and a ground core. However, the present disclosure is not limited thereto. The types of the cores may be decided in light of actual signal-transmission requirements.

In the example shown in FIG. 2, the plurality of wires may include wire(s) 7 and wire(s) 8, whose cores may be made of, for instance, pure copper. The wire(s) 7 and wire(s) 8 may be, for instance, a ground core and a DC power supply wire, respectively. Each of the wire(s) 7 and wire(s) 8 may be formed by twisting several wire cores, for instance, each of the wire(s) 7 and wire(s) 8 may be a twisted pair or a qudraplex, so as to reduce the electromagnetic interference effectively.

In the example shown in FIG. 2, the plurality of signal wires may further include wire(s) 9, wire(s) 10, wire(s) 11 and wire(s) 12, whose cores are made of tinned copper. The wire(s) 9, wire(s) 10, wire(s) 11 and wire(s) 12 may be used to transmit any signal including a user-defined signal.

The wires 3-12 as a whole may be externally surrounded by the shield 105 that contains different kinds of metal wires, so as to be shielded from the outside. The wires 1-12 as a whole may be externally surrounded by the sheath 104 made of, for instance, PVC VW-1 for insulation and fire resistance.

It should be understood by a person skilled in the art that, FIG. 2 only shows one example of the composite cable. The specific structure, material, function or the like of the composite cable can be designed by a person skilled in the art in light of actual needs, provided that the composite cable satisfies the user's requirements for transmitting signal.

As an example, the metal wires contained in the shield 105, may include different kinds of metal wires with shielding capabilities for different physical fields, such as electric-shielding metal wires for an electric field (e.g., copper wires) and magnetic-shielding metal wires for a magnetic field (e.g., iron wires). Thus, the present disclosure meets a number of aspects of shielding requirements, including both magnetic-shielding requirement and electric-shielding requirement.

However, it should be understood by a person skilled in the art that, the metal wires selected as above are merely examples. And a person skilled in the art can decide, depending on actual needs, how many kinds of and what kinds of metal wires are to be selected, and what proportion each of the selected metal wires accounts for, provided that the selected metal wires can meet shielding requirements for different physical fields.

As an example of the shield 105, it may be formed with a netlike structure which is woven from a wire harness formed by different kinds of metal wires. The present disclosure is not meant to place any particular restrictions on the proportion of each kind of metal wires in the wire harness or the weaving method of the wire harness. They can be decided by a person skilled in the art in light of shielding requirements, costs or other factors. For instance, when the shield needs to have a higher shielding capability for a particular physical field, a possible approach is to increase the proportion of a metal wire that has excellent shielding performance for the particular physical field.

Figure 3:
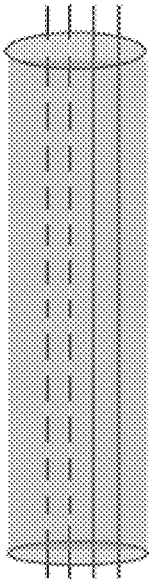
FIG. 3 and FIG. 4 are schematic diagrams showing an exemplary wire harness and an exemplary netlike structure of a shield.
Figure 4:
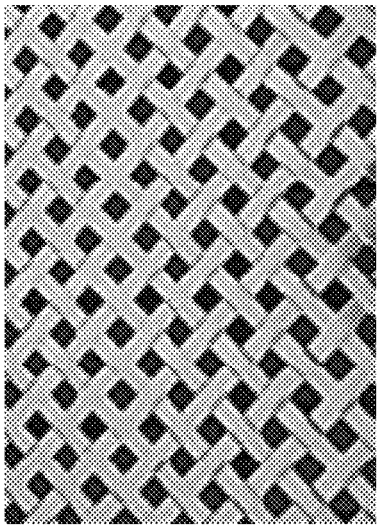

FIG. 3 and FIG. 4 are schematic diagrams showing an exemplary wire harness and an exemplary netlike structure of a shield. As shown in FIG. 3, there is a wire harness that is formed by combining a number of copper wires (represented by the solid lines) with the same number (or different number as needed) of iron wires (represented by the dashed lines). The resultant wire harnesses are woven into a netlike structure. Juxtaposition, twist or any other proper method may be used to form the wire harness.

As an example of the shield 105, it may be a netlike structure with, for example, prism, rectangle or square meshes, that is formed by alternatingly weaving two groups of parallel wire harness. FIG. 4 illustrates a possible weaving method.

As an example of the shield 105, it may be formed by winding a wire harness that is formed by juxtaposing different kinds of metal wires in a transverse direction.

Generally speaking, signal lines are wider in outer diameter and are used in a greater quantity than power lines. Thus, when the interior of a cable is filled with signal lines and power lines, the signal lines and power lines do not match each other, and this makes the cable instable. To address that problem, this embodiment provides a solution: dividing the first wire assembly into a plurality of first wire sub-assemblies, dividing the second wire assembly into a plurality of wires, and arranging the first wire sub-assemblies and the wires in such a way that they match each other in shape and location to such an extent that the interior of the cable is sufficiently filled by them.

FIGS. 5*a*-5*g* are structural diagrams showing examples of a composite cable according to an embodiment of the present disclosure.

As an example of the first wire assembly, it may include at least two first wire sub-assemblies 1011, as shown in FIGS. 5*a*, 5*b*, 5*c*, 5*f* and 5*g*. As an example of the first wire sub-assemblies, each of them may be surrounded by a sub-shield. The sub-shield may be the above shield, which is made of different kinds of metals, or a shield made of a single metal, e.g., aluminum foil. It is also possible that outside all the first wire sub-assemblies is surrounded by a shield made of different kinds of metals.

As an example of the second wire assembly, it may comprise at least two wires 1021 each of which may be externally surrounded by an insulating layer, as shown in FIGS. 5*a*-5*g*. Of those wires 1021, 1021*a* represents a fire wire, and 1021*b* represents a zero line. There may be one or more fire wires 1021*a* and one or more zero lines 1021*b*.

Figure 5A:
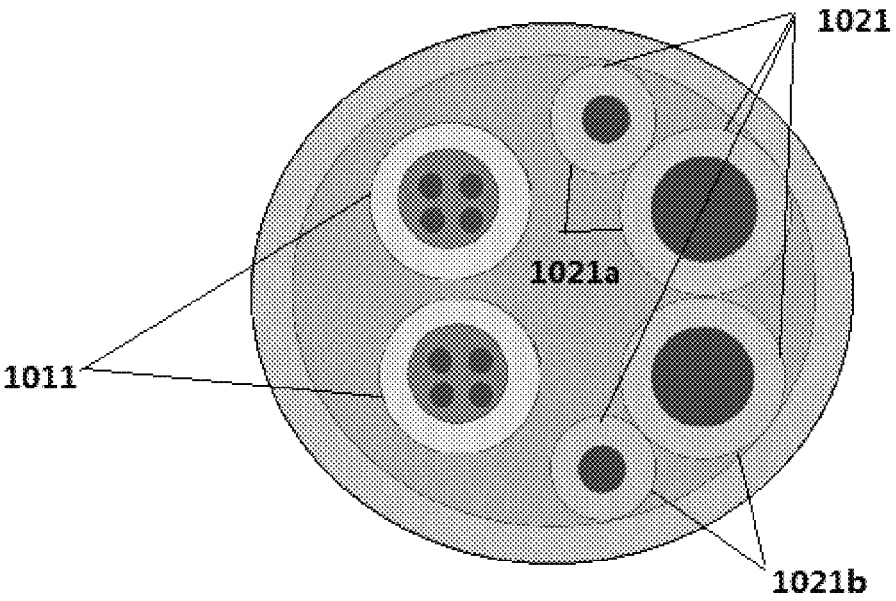
FIGS. 5*a*-5*g* are structural diagrams showing examples of a composite cable according to an embodiment of the present disclosure.
Figure 5B:
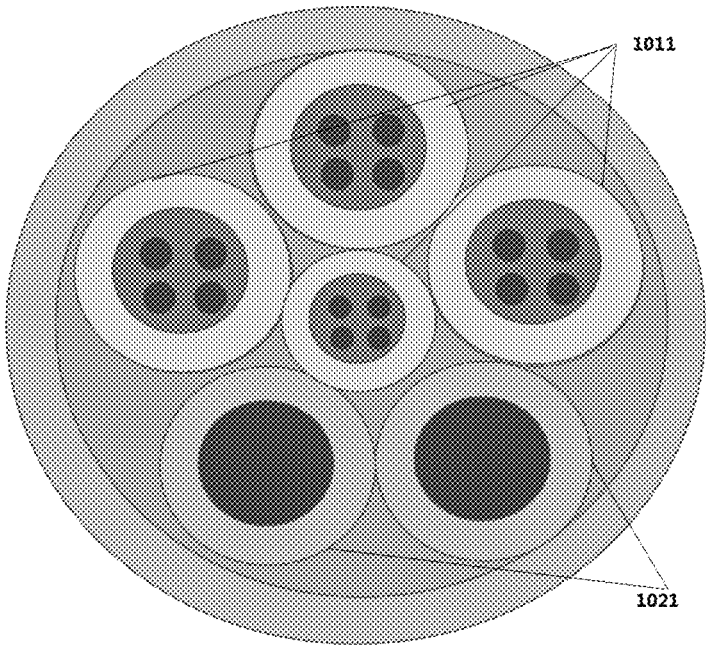
Figure 5C:
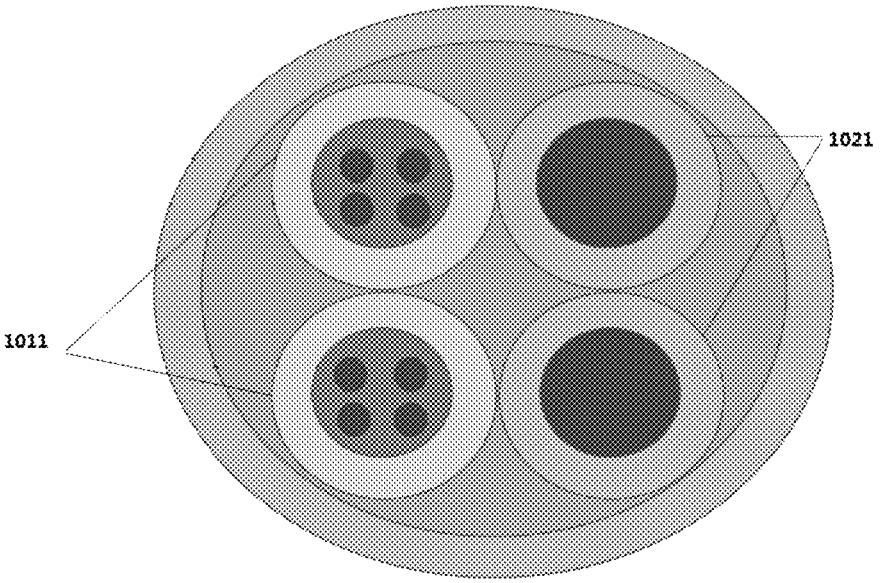
Figure 5D:
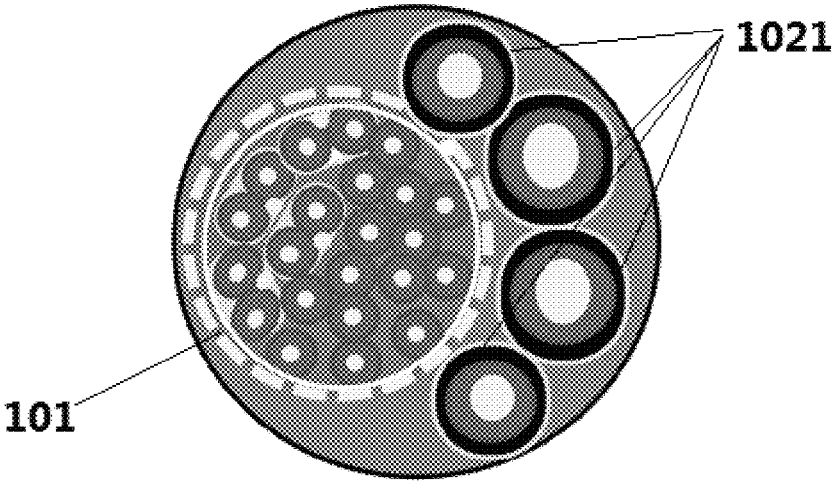
Figure 5E:
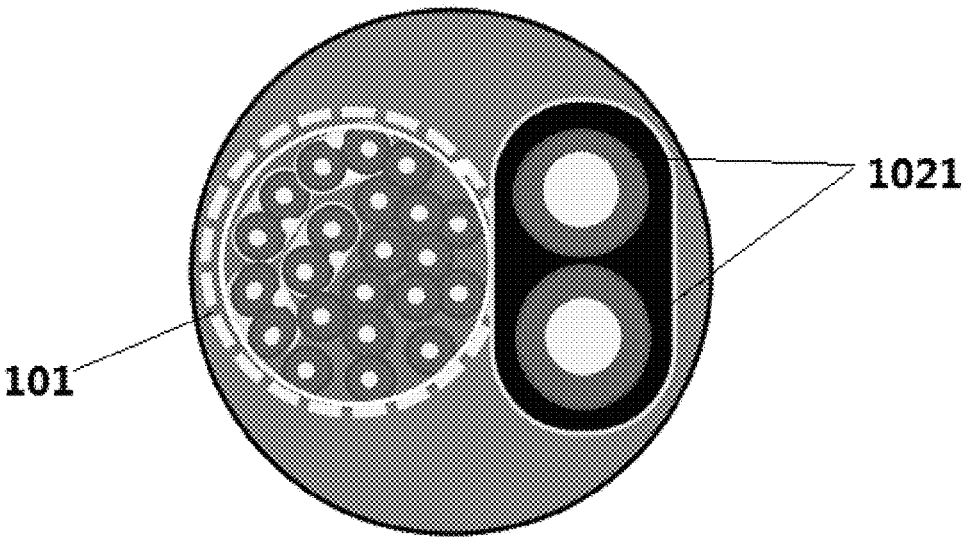
Figure 5F:
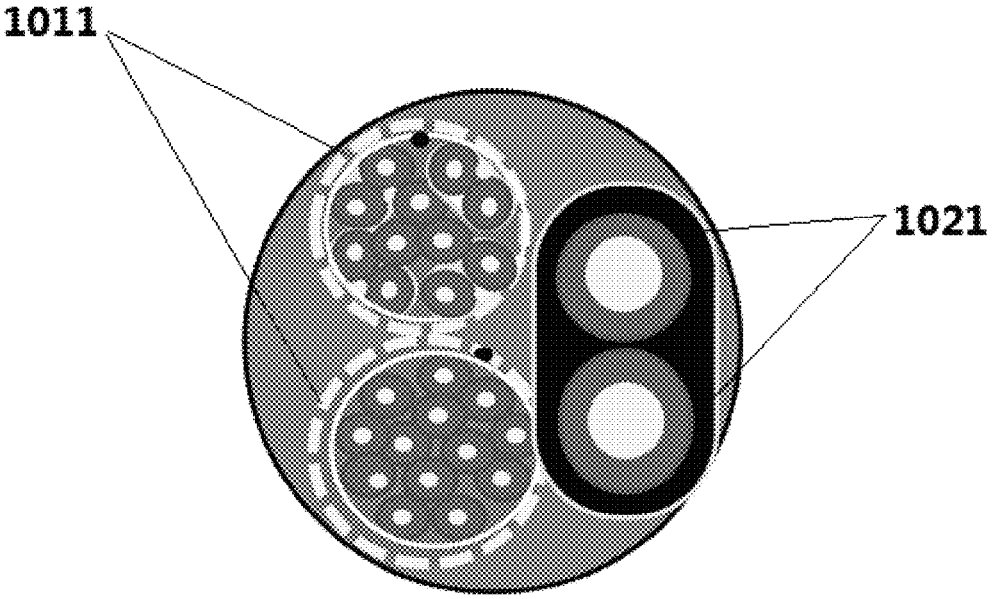
Figure 5G:
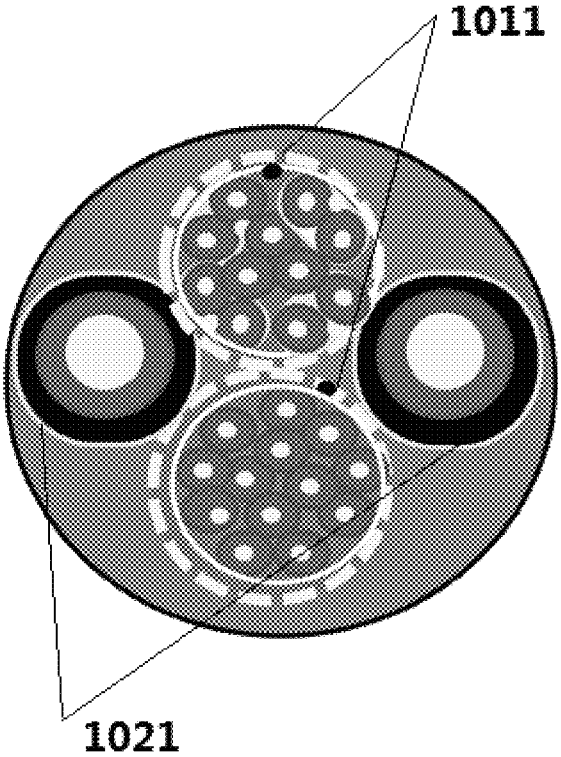

As an example of a stable composite cable, a wire harness formed by the first wire sub-assemblies and the wires in the second wire assembly has a cross section whose outline is symmetric with respect to a diameter of the composite cable, such as a polygon symmetric with respect to a diameter of the composite cable, as shown in FIGS. 5*a*-5*g*. Take FIG. 5*a* for example, two thick wires and two sub-assemblies are juxtaposed with gaps between them, and the gaps are filled with two thin wires, leading to an overall hexagonal outline. As shown in FIG. 5*b*, one thin sub-assembly is in the middle with three thick sub-assemblies and two wires of the same thickness surrounding the thin sub-assembly, leading to an overall pentagonal outline. As shown in FIG. 5*g*, two sub-assemblies and two wires are juxtaposed, leading to a quadrilateral outline.

It should be understood by a person skilled in the art that how to arrange the first and second wire assemblies is not limited to the above examples. And they can be arranged in any way, provided that they form a stable structure. For instance, a wire harness formed by the first wire sub-assemblies and wires in the second wire assembly may have a cross section whose outline is circular-like, as shown in FIG. 2.

It should be understood by a person skilled in the art that those structures shown in the aforementioned drawings are given for the sake of exemplification. And the present disclosure is not limited to them.

It is possible for a person skilled in the art to obtain a stable composite cable, based on this embodiment, by arranging the number of the first wire sub-assemblies and that of the wires in the second conducting-wire assembly in light of the function of signals to be submitted, ampacity requirements for the source, and the like. For instance, the first wire assembly may be divided into a plurality of first wire sub-assemblies (see, for example, FIGS. 5*a*, 5*b*, 5*c*, 5*f* and 5*g*) in light of the function of signals to be submitted. The second wire assembly may be divided into a desired number of wires (see, for example, FIGS. 5*a* and 5*d*), so that a sum of ampacities of all the wires meets the ampacity requirement for the second wire assembly. The first wire sub-assemblies may be of the same diameter or be different from each other in diameter, a first wire sub-assembly and a wire may be of the same diameter or be different from each other in diameter, and the wires may be of the same diameter or be different from each other in diameter, depending on actual needs. That is, the first wire assembly may be divided into first wire sub-assemblies of different thicknesses (see, for example, FIG. 5*b*), and the second wire assembly may be divided into wires of different thicknesses (see, for example, FIGS. 5*a* and 5*d*, in which the fire wires 1021 are divided into a thin one and a thick one, and the zero lines 1021*b* are divided into a thin one and a thick one). Arranging the thick and the thin like that allows space inside the sheath to be sufficiently filled, leading to stable structures. Besides, dividing the second wire assembly amounts to thickening the conductive cable, and thus the cable has an increased loading capability for current.

For instance, a first wire assembly 101 may be divided into a plurality of first wire sub-assemblies 1011 (see, for example, FIGS. 5*a*, 5*b*, 5*c*, 5*f* and 5*g*) that are used to fill the composite cable. Compared with the first wire assembly 101, the first wire sub-assemblies 1011 are smaller in diameter and thus can be located more flexibly, so they enable the outer diameter of the composite cable to be smaller and be filled more sufficiently and thus improve the composite cable's stability. Taking FIG. 5*c* for example, in FIG. 5*c*, two sub-assemblies of the same thickness and two wires of the same thickness are juxtaposed to form a quadrilateral outline. The first wire assembly 101 is functionally divided into two sub-assemblies 1011, one of which serves to transmit an HDMI-compatible signal or any other signal as needed, and the other serves to transmit a control signal or any other signal as needed.

A second wire assembly 102 may be divided into, for instance, a plurality of wires 1021 (see, for example, FIGS. 5*a* and 5*d*) that are used to fill the composite cable. Likewise, those wires enable the composite cable to be smaller in diameter and be more stable.

Either or both of the first wire assembly and the second wire assembly may be divided in any way by a person skilled in the art depending on actual needs, provided that the dividing way effects a stable composite cable.

The above description relates only to embodiments of the present disclosure. The protection scope of the present disclosure is not limited thereto and covers variants or replacements which a person skilled in the art can easily think of and that fall within the technical range of the present disclosure. The protection scope of the present disclosure is determined by the appended claims.

PRACTICAL APPLICABILITY

The composite cable according to examples of the present disclosure is excellent in shielding performance for different requirements.

What is claimed is:

1. A composite cable comprising:

a first wire assembly capable of transmitting signals;

a second wire assembly capable of transmitting power supply;

a sheath made of insulating material and configured to enclose the first wire assembly and the second wire assembly; and a shield comprising wires which are made of different kinds of metal and configured to surround the first wire assembly, wherein the second wire assembly comprises at least two wires, each of the at least two wires surrounded by an insulating layer, the first wire assembly comprises at least two first wire sub-assemblies of different thicknesses, each of the at least two first wire sub-assemblies surrounded by a sub-shield, wherein the sub-shield comprises wires which are made of different kinds of metal, and wherein the first wire sub-assemblies and the at least two wires in the second wire assembly are arranged inside the sheath to match each other in shape and location to make the composite cable stable.

2. The composite cable according to claim 1, wherein the shield has a netlike structure which is woven from a wire harness formed by the wires which are made of different kinds of metal.

3. The composite cable according to claim 2, wherein the wires which are made of different kinds of metal comprise an electric-shielding metal wire and a magnetic-shielding metal wire.

4. The composite cable according to claim 3, wherein the electric-shielding metal wire comprises a copper wire.

5. The composite cable according to claim 3, wherein the magnetic-shielding metal wire comprises an iron wire.

6. The composite cable according to claim 1, wherein a wire harness formed by the first wire sub-assemblies and the wires in the second wire assembly, has a cross section whose outline is a polygon symmetric with respect to a diameter of the composite cable.

7. The composite cable according to claim 1, wherein a wire harness formed by the first wire sub-assemblies and the wires in the second wire assembly, has a cross section whose outline is circular-like.

8. The composite cable according to claim 1, wherein the first wire assembly comprises one or more of a high definition multimedia interface (HDMI) wire, a user-defined signal line, a control line, and a data line.

9. The composite cable according to claim 8, wherein the first wire assembly further comprises a DC power supply line and a ground wire.

10. The composite cable according to claim 1, wherein the at least two wires of the second wire assembly are of different thicknesses.

11. The composite cable according to claim 1, wherein a sum of ampacities of all of the wires of the second wire assembly is equal to or more than an ampacity required for the second wire assembly.

* * * * *